United States Patent [19]

Hait

[11] Patent Number: 4,877,010

[45] Date of Patent: Oct. 31, 1989

[54] OUTDOOR COOKING UNIT WITH DISPOSABLE COMPONENT

[75] Inventor: Paul W. Hait, Los Gatos, Calif.

[73] Assignee: Pyromid, Inc., San Jose, Calif.

[21] Appl. No.: 285,660

[22] Filed: Dec. 16, 1988

Related U.S. Application Data

[62] Division of Ser. No. 726,835, Apr. 24, 1985.

[51] Int. Cl.[4] ..... F24C 1/16

[52] U.S. Cl. ..... 126/9 A; 126/9 R; 126/39 M; 220/405; 229/3.5 MF

[58] Field of Search ..... 126/9 R, 39 M, 9 A, 126/9 B; 99/449, 444; 220/470, 405, 406, 450; 229/3.5 MF, 114

[56] References Cited

U.S. PATENT DOCUMENTS

| | | | |
|---|---|---|---|
| 1,102,649 | 7/1914 | Dix . | |
| 1,238,142 | 8/1917 | Hitchcock . | |
| 2,469,885 | 5/1949 | Molla | 126/144 |
| 2,943,557 | 7/1960 | Suehlsen | 99/421 |
| 3,109,420 | 11/1963 | Ott et al. | 126/9 |
| 3,194,429 | 7/1965 | Bouet | 220/85 |
| 3,353,527 | 11/1967 | Anderson | 126/25 |
| 3,384,066 | 5/1968 | Tufts | 126/9 |
| 3,385,282 | 5/1968 | Lloyd | 126/9 A |
| 3,601,280 | 8/1971 | Mills | 220/63 |
| 3,682,154 | 8/1972 | Mollere | 126/9 |
| 3,765,397 | 10/1973 | Henderson | 126/25 |
| 3,841,298 | 10/1974 | Sellors | 126/9 A |
| 4,140,099 | 9/1979 | Newport | 126/9 |
| 4,149,514 | 4/1979 | Latouf | 126/9 |
| 4,204,516 | 5/1980 | Figura | 126/9 |
| 4,210,118 | 7/1980 | Davis et al. | 126/25 |
| 4,254,863 | 3/1981 | Katcs et al. | 206/216 |
| 4,413,609 | 11/1983 | Tisdale | 126/25 |
| 4,508,094 | 4/1985 | Hait | 126/9 |
| 4,531,505 | 7/1985 | Hait et al. | 126/9 |
| 4,531,506 | 7/1985 | Chambers et al. | 126/9 A |
| 4,539,973 | 9/1985 | Hait | 126/43 |
| 4,545,359 | 10/1985 | Hait | 126/9 |
| 4,624,238 | 11/1986 | Hait | 126/9 |

FOREIGN PATENT DOCUMENTS

| | | | |
|---|---|---|---|
| 136398 | 8/1948 | Australia | 24.2/24.1 |
| 2439805 | 3/1976 | Fed. Rep. of Germany | 99/242 |
| 1467646 | 3/1977 | United Kingdom | 126/9 R |

*Primary Examiner*—Ira S. Lazarus
*Assistant Examiner*—Christopher Hayes
*Attorney, Agent, or Firm*—Jack M. Wiseman

[57] ABSTRACT

An outdoor cooking unit in which a bendable, disposable and non-combustible member is employed. The member is formed with a closed bottom and upstanding panels to form an inverted, truncated, pyramidal configuration with an open top. A fuel element is disposed within the member.

9 Claims, 6 Drawing Sheets

OUTDOOR COOKING UNIT WITH DISPOSABLE COMPONENT

RELATED CASE

This application is a divisional application of my pending application, Ser. No. 06/726,835 Apr. 24, 1985, for Outdoor Cooking Unit With Disposable Component.

BACKGROUND OF THE INVENTION

The present invention relates in general to outdoor cooking units, and more particularly to an outdoor cooking unit that is foldable into a compact, collapsed form for ease in transporting and storing.

In the U.S. Pat. No. 4,489,706, to Hait, issued on Dec. 25, 1984, for Multi-Purpose Fuel Efficient Portable Stove/Heater, there is disclosed a cooking unit particularly adapted to be used outdoors as an environmentally enclosed heating and cooking system.

In the U.S. Pat. No. 4,508,094, to Hait, issued on Apr. 2, 1985, for Convertible Cooking Unit, there is disclosed a cooking unit that includes a truncated pyramidal firebox and a similar support member. The firebox ant the support member are disposed in nested relation. Accessories, such as grills and cover members, are adapted to be arranged in several modes to provide different cooking arrangements and to enclose all the members in a compact form for storage or transporting.

It is a time consuming chore to maintain the interior surfaces of conventional outdoor cooking units clean. In some instances, the interior walls of such cooking units have a tendency to oxidize. It is widely recognized that cooking units used for barbequing food tend to collect grease on the interior walls thereof. The collection of grease and also the collection of ashes have presented problems to the operators of conventional outdoor cooking units. It is apparent that environmentalists dislike the dumping of ashes or other foreign material in the wilderness.

SUMMARY OF THE INVENTION

An outdoor cooking unit in which an inverted, truncated, pyramidal firebox is supported in nested relation on a truncated pyramidal support member. A bendable, disposable and non-combustible liner is disposed along the inner surfaces of the firebox and contoured to conform to the configuration of the interior of the firebox.

In another embodiment of the present invention, an outdoor cooking unit comprises an inverted, truncated pyramidal firebox made of bendable, disposable and non-combustible sheet material that is supported in nested relation on a truncated pyramidal support member.

In still another embodiment of the present invention, an outdoor cooking unit comprises an inverted, truncated pyramidal firebox made of bendable, disposable and non-combustible sheet material that is supported in nested relation on a truncated pyramidal support member made of bendable, disposable and non-combustible sheet material.

According to the present invention, bendable and non-combustible sheet material is folded to form a liner in the shape of a truncated pyramid. The bendable and non-combustible sheet material is also folded to form a truncated pyramidal firebox, a truncated pyramidal support member, and a hood that is disposable over a truncated pyramidal firebox.

By virtue of the present invention, an outdoor cooking unit can be maintained clean with facility and the ashes confined for easy removal. The interior walls of the outdoor cooking unit can be maintained relatively oxidize free without the loss of a bright finish. Ash can be removed from campgrounds, beaches and patios in a safe and sanitary manner.

DESCRIPTION OF THE PREFERRED EMBODIMENTS

Figure 1:
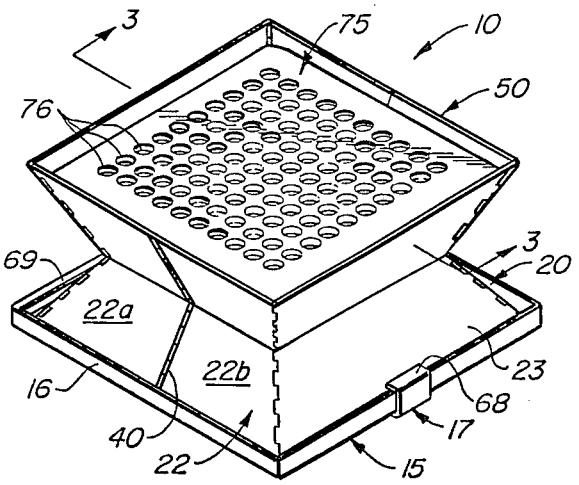
FIG. 1 is a perspective view of a cooking unit embodying the present invention.
Figure 2:
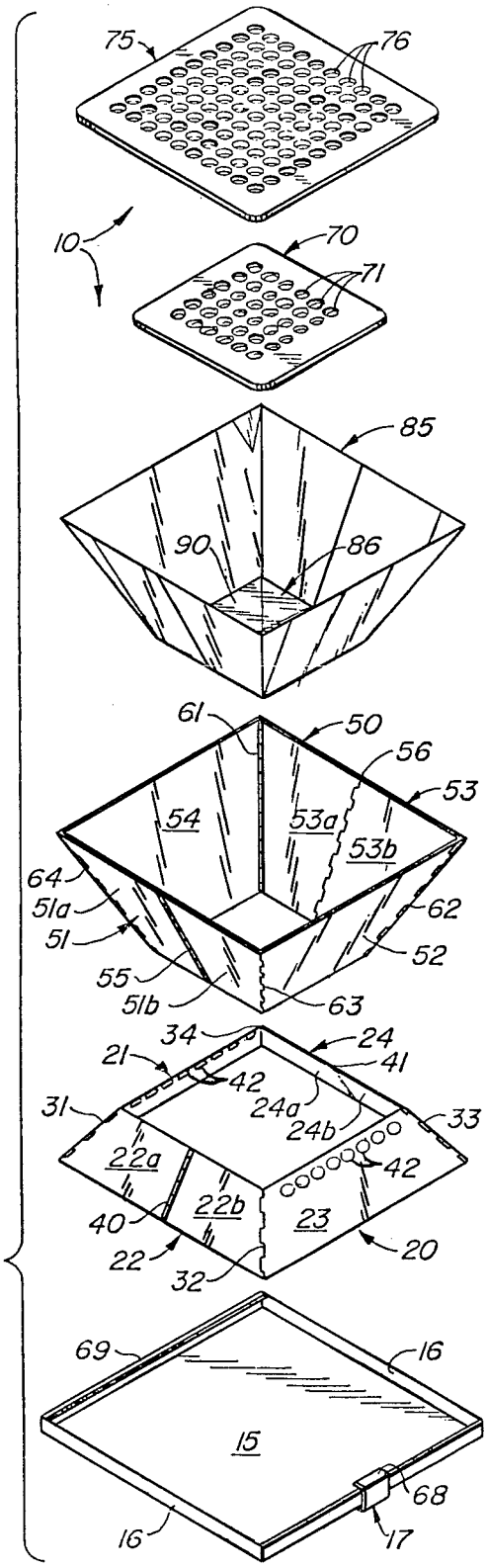
FIG. 2 is an exploded perspective view of the cooking unit shown in FIG. 1.

Illustrated in FIGS. 1 and 2 is a cooking unit 10 comprising a base 15 having a quadrilateral configuration. The base 15 includes upstanding flanges 16 along the periphery thereof and a yieldable upstanding latch 17. In the exemplary embodiment, the base or support 15 is made from a suitable metal.

Disposed on the base 15 within the perimetric flanges 16 thereof is a foldable support member or support collar 20 having a truncated, pyramidal configuration in its extended state. In the exemplary embodiment, the support member or support collar 20 is made from a suitable metal. The support member 20 comprises side panels 21–24. Each side panel 21–24 has a trapezoidal configuration. Juxtaposed non-parallel edges of the side panels 21–24 are joined by suitable hinges 31–34. The panels 22 and 24 are confronting panels that are respectively formed by adjacent panel sections *22a*, *22b* and *24a*, *24b*.

The panel sections *22a* and *22b* of the panel 22 are joined at their adjacent edges by a suitable hinge 40 and the panel sections *24a* and *24b* of the panel 24 are joined at their adjacent edges by a suitable hinge 41. The adjacent edges of the panel sections *22a* and *22b* joined by the hinge 40 are orthogonal to the parallel edges of the panel 22 and are located generally midway between the non-parallel edges thereof. Similarly, adjacent edges of the panel sections 24*a* and 24*b* joined by the hinge 41 are orthogonal to the parallel edges of the panel 24.

Figure 5:
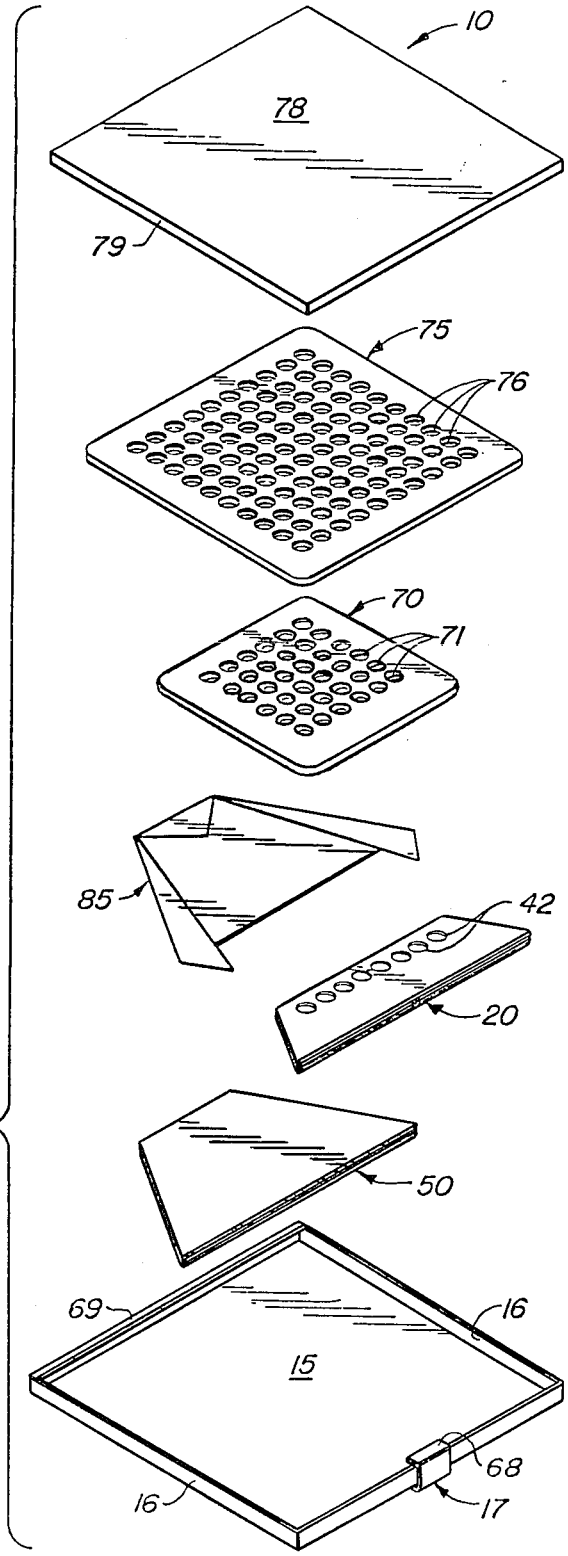
FIG. 5 is an exploded perspective view of the cooking unit shown in FIG. 4 in its compact transporting and storing mode.

To fold the support member or support collar 20 into a compact state, the panels 22 and 24 are folded inwardly about their respective hinges 40 and 41 so that the panels 22 and 24 are disposed between the confronting panels 21 and 23 with the hinges 40 and 41 adjacent one another. Thus, the support member 20 can assume a folded, generally flat compact state or an extended, truncated pyramidal configuration (FIGS. 2 and 5).

In the extended state, the support member 20 is hollow and has a larger, lower open end and a smaller upper open end. Formed in the panels 21 and 23 of the support member 20 are openings 42 for the circulation of air to aid in the combustion of fuel. Disposed above the support member 20 is a firebox or cooking chamber 50, which has an inverted, truncated, pyramidal configuration in its extended state (FIGS. 1 and 2). In the exemplary embodiment, the firebox or cooking chamber 50 is made of stainless steel. The firebox 50 comprises side panels 51–54. Each side panel 51–54 has a trapezoidal configuration. Juxtaposed non-parallel edges of the side panels 51–54 are joined by suitable hinges 61–64. The panels 51 and 53 are confronting panels that are respectively formed by adjacent panel sections 51*a*, 51*b* and 53*a*, 53*b*.

The panel sections 51*a* and 51*b* of the panel 51 are joined at their adjacent edges by a suitable hinge 55 and the panel sections 53*a* and 53*b* of the panel 53 are joined at their adjacent edges by a suitable hinge 56. The adjacent edges of the panel sections 51*a* and 51*b* joined by the hinge 55 are orthogonal to the parallel edges of the panel 53 and are located generally midway between the non-parallel edges thereof.

To fold the firebox or cooking chamber 50 into a compact state, the panels 51 and 53 are folded inwardly about their respective hinges 55 and 56 so that the panels 51 and 53 are disposed between the confronting panels 52 and 54 with the hinges 55 and 56 adjacent one another. Thus, the firebox or cooking chamber 50 can assume a folded, generally flat compact state or an extended inverted, truncated pyramidal configuration (FIGS. 2 and 5).

Figure 3:
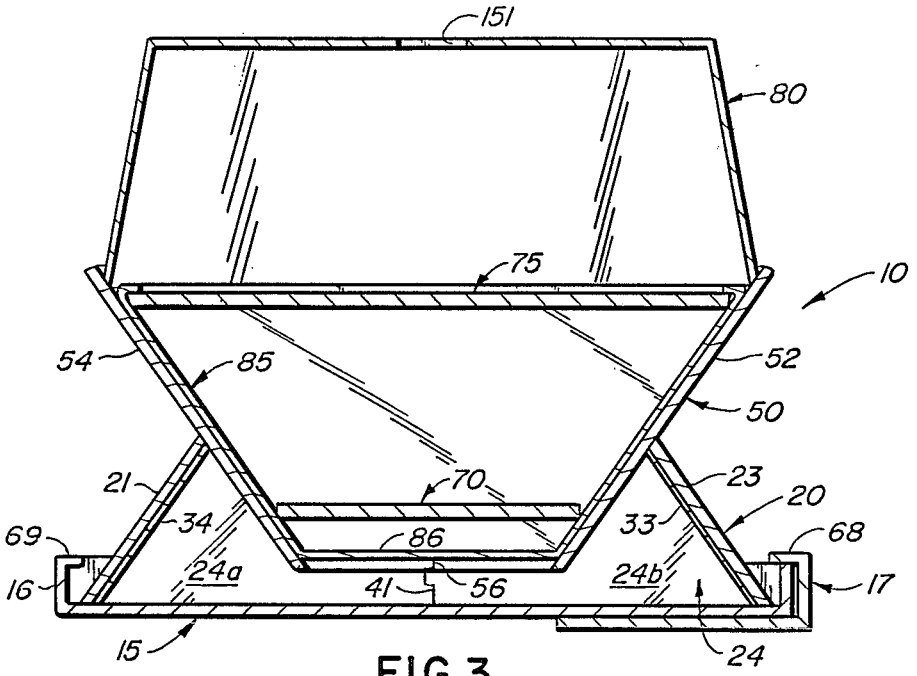
FIG. 3 is a vertical cross-section of the cooking unit shown in FIG. 1 taken along line 3—3 of FIG. 1 illustrated with a bendable, disposable and non-combustible lining for the firebox and a bendable, disposable hood.

In the extended state, the firebox or cooking chamber 50 is hollow and has a smaller, lower open end and a larger, upper open end. The lower smaller open end of the firebox 50 nests within the smaller, upper open end of the support member 20 (FIGS. 1 and 3). Hence, the firebox 50 rests on the support member 20.

The apex of the support member 20 extends upwardly and outside the firebox 50 to form a quadrilateral support for the firebox 50. Along the inner walls of the firebox 50 is seated a fire grate 70 spaced from the lower narrow end of the firebox 50. The fire grate 70 is made of a suitable rigid material, such as stainless steel. A container of flammable fuel, such as canned jellied alcohol or a solid fuel tablet, such as ESBIT fuel tablet or other fuel, seats on the fire grate 70. Seated on the upper, larger open end of the firebox 50 is a cooking grill 75.

The grill 75, in the preferred embodiment, is made of a suitable rigid material, such as stainless steel.

Figure 4:
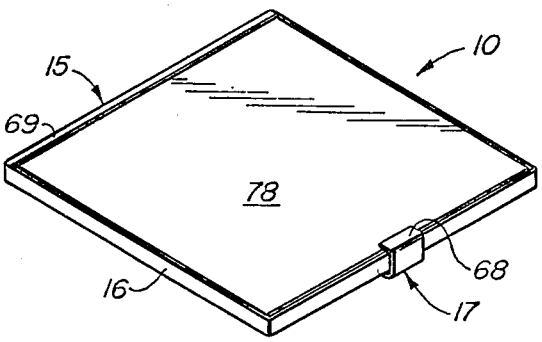
FIG. 4 is a perspective view of the cooking unit shown in FIG. 1 in its compact transporting and storing mode.

For dismantling the cooking unit 10 to form a compact, collapsed unit for ease in storing and transporting (FIGS. 4 and 5), a cover 78, the grill 75, the grate 70, the firebox 50 and the support member 20 are removed in succession. The support member 20 and the firebox 50 are folded, respectively, into compact, generally flat configurations (FIG. 5). The folded firebox 50 and the folded support member 20 are disposed, respectively, directly onto the base 15 between the upstanding flanges 16 thereof. Then, the grate 70 is placed onto the folded firebox 50 and the folded support member 20 between the upstanding flanges 16 of the base 15. The grill 75 may be placed on the base 15 and the folded firebox 50 and the folded support member 20 can be disposed directly onto the grate 70 between the upstanding flanges 16 of the base 15.

The cover 78 is placed in a container-closed position over the base 15. The cover 78 is formed with depending flanges 79 along the perimeter thereof. The flanges 79 of the cover 78 are disposed within the upstanding flanges 16 of the base 15 to form a container therewith. The yieldable upstanding latch 17 is formed with a lip 68 to clasp the adjacent edge of the cover 78. The opposite edge of the base 15 is formed with an overhanging ledge 69 under which the opposite edge of the cover 78 is disposed.

Thus, the cover 78 is detachably secured to the base 15 by placing one edge thereof under the ledge 69 of the base 15 and the opposite edge thereof below the lip 68 of the latch 17 by moving the yieldable latch 17 away from the cover 78. The latch 17 is then released to clasp the adjacent edge of the cover 78. To remove the cover 78 from the base 15, the latch 17 is moved outwardly away from the cover 78 and the cover 78 is moved away from the ledge 69.

The cooking unit of the present invention is fuel efficient. The truncated, pyramidal configuration of the firebox or cooking chamber is able to reflect a concentrated source of heat and direct the heat along a conductive path that efficiently heats the cooking grill. Stainless steel reflective walls efficiently direct the heat along the conductive path. The surface angles of a truncated, pyramidal firebox or cooking chamber direct the radiant energy from the combustible fuel along a path to the cooking grill to efficiently heat the cooking grill. In addition to the foregoing, the present invention provides a foldable cooking unit that is compact to facilitate the transportation and storage thereof.

In one embodiment of the present invention (FIGS. 2 and 3), a bendable, disposable and non-combustible liner 85 is disposed along the inner wall of the firebox 50 when the cooking unit 10 is extended for cooking food. The liner 85, in the preferred embodiment, is an imperforate sheet of material with inner reflective surfaces. The shape of the liner 85 conforms to the configuration of the inner wall of the firebox 50 and has a lower end wall 86. Hence, the liner 85 has an inverted truncated pyramidal configuration. In the preferred embodiment, the liner is a metallic paper made of tempered aluminum foil having a thickness within the gauge range of 0.001 inches to 0.005 inches. The tempering is in the range of 50% to 100%. The liner 85 is disposable and is readily flexible so as to conform to the configuration of the inner surface of the firebox 50. Other metallic paper foils may be suitable, such as copper foil and stainless steel foil.

The upper free edges of the liner 85 can be folded over the upper perimetric edge of the cooking grill 75 so that removal of the cooking grill from the firebox 50 serves to remove therewith the liner 85. Alternatively, the upper free edges of the liner 85 can be folded over the upper edges of the firebox 50 so that the cooking grill 75 can be removed separately from the firebox 50. When the liner 85 collects ashes and grease, the upper section of the liner 85 is folded over to form an enclosure with the grease and ashes contained therein. This enables the liner 85, the collected grease and the collected ashes to be discarded as a bag-like unit for disposal at an appropriate location.

A hood 80 made of bendable, non-combustible sheet material, such as aluminum foil above-described, may have its lower open end disposed within the firebox 50 and on the grill 75 or above the grill 75. The open end of the hood 80 is seated on or above the grill 75 and has a quadrilateral configuration and a perimetric dimension substantially equal to the perimetric configuration of the grill 75. The liner 85 is originally in a folded state (FIG. 5) and may be stored in the compact container of the cooking unit (FIG. 4) or may be stored separately in a suitable package containing a plurality of liners.

Solid fuel 90 (FIG. 2) may be disposed loosely along the bottom wall 86 of the liner 85. The fuel 90 can be caused to adhere to the upper surface of the bottom wall 86 or be disposed within a pocket thereof. The fuel 90 can be pulverized or in a paste form. Solid fuel tablets, such as ESBIT fuel tablets, can be pulverized or made into a suitable paste for use as a fuel. The fuel 90 is employed for the ignition of a fire.

Figure 6:
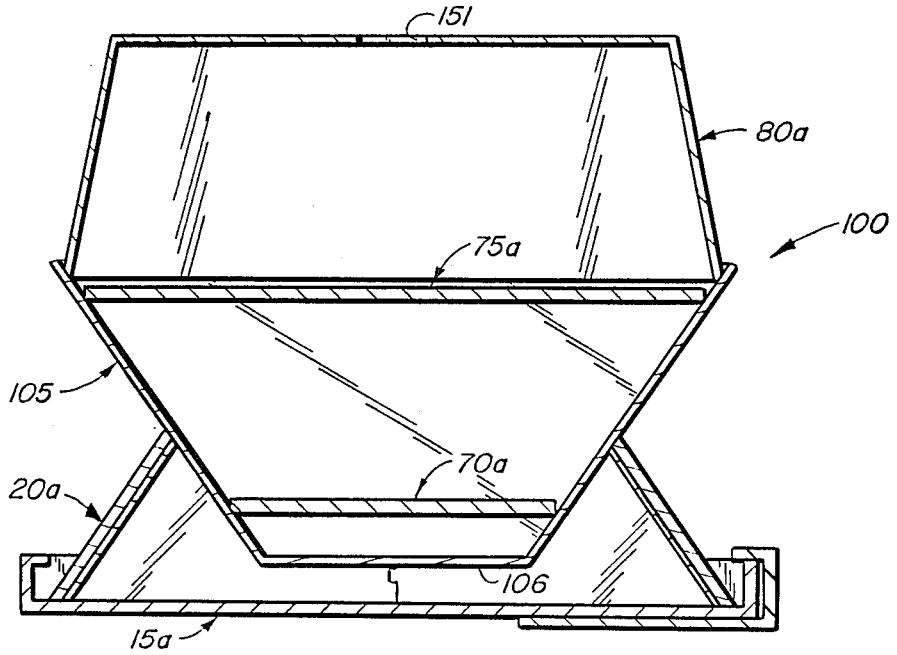
FIG. 6 is a vertical cross-section of the cooking unit similar to FIG. 3, but illustrating the firebox as being made of bendable, disposable and non-combustible sheet material.

Illustrated in FIG. 6 is a cooking unit 100. Parts of the cooking unit 100 similar in construction and function to parts of the cooking unit 10 are designated with the same reference numeral and a suffix "a". In the cooking unit 100, an inverted truncated pyramidal firebox or cooking chamber 105 is made of suitable bendable, disposable and non-combustible sheet material, such as aluminum foil above-described. The firebox 105 is disposed above the support member 20*a*. The firebox 105, which is hollow, has a lower end with an end wall 106 and a larger open upper end. The lower smaller end of the firebox 105 nests within the smaller, upper open end of the support member 20*a*.

Disposed within the firebox 105 and spaced from the lower end wall 106 is a fire grate 70*a*. A container of flammable fuel, such as canned jellied alcohol, or a solid fuel tablet, such as ESBIT fuel tablet, seats on the fire grate 70*a*. A hood 80*a* may be employed to seat within the firebox 105 either on or above the grill 75*a*.

While the cooking unit 100 is being disassembled and after the removal of the grill 75*a* and the fire grate 70*a*, the firebox 105, which has collected ashes and grease therein, is folded over to form an enclosure with the grease and ashes contained therein. This enables the firebox 105, the collected grease and collected ashes to e discarded as a bag-like unit for disposal at an appropriate location.

Figure 7:
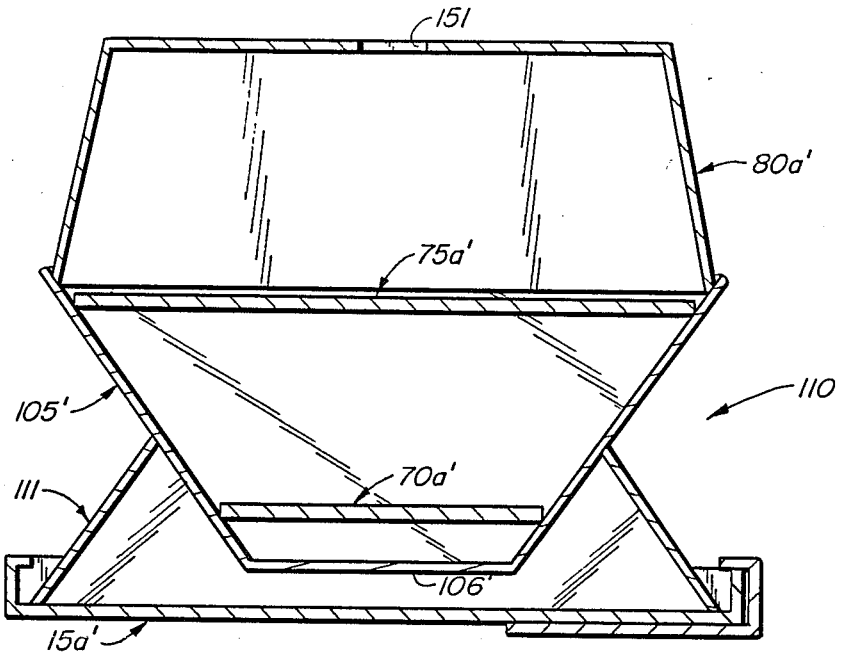
FIG. 7 is a vertical cross-section of the cooking unit similar to FIG. 3, but illustrating the firebox, the support member and the hood as being made of bendable, disposable and non-combustible sheet material.

In another modification of the present invention, a cooking unit 110 (FIG. 7) is similar to the cooking unit 100 (FIG. 6) except for the support member or support collar. Therefore, parts of the cooking unit 110 similar in construction and function to parts of the cooking unit 100 are designated with the same reference numeral and a prime suffix. In the cooking unit 110, a truncated pyramidal support member or support collar 111 is made of suitable bendable, non-combustible sheet material, such as aluminum foil above-described. The support member 111 is disposed below the firebox 105'. The support member 111, which is hollow and disposable, has a smaller open upper end and a larger open lower end. The support member 111 may, but need not have reflective surfaces. The smaller end of the firebox 105' nests within the smaller, upper open end of the support member 111. The larger open end of the support member 111 seats on a base 15*a'*, which, in the exemplary embodiment, is made of suitable metal.

Figure 8:
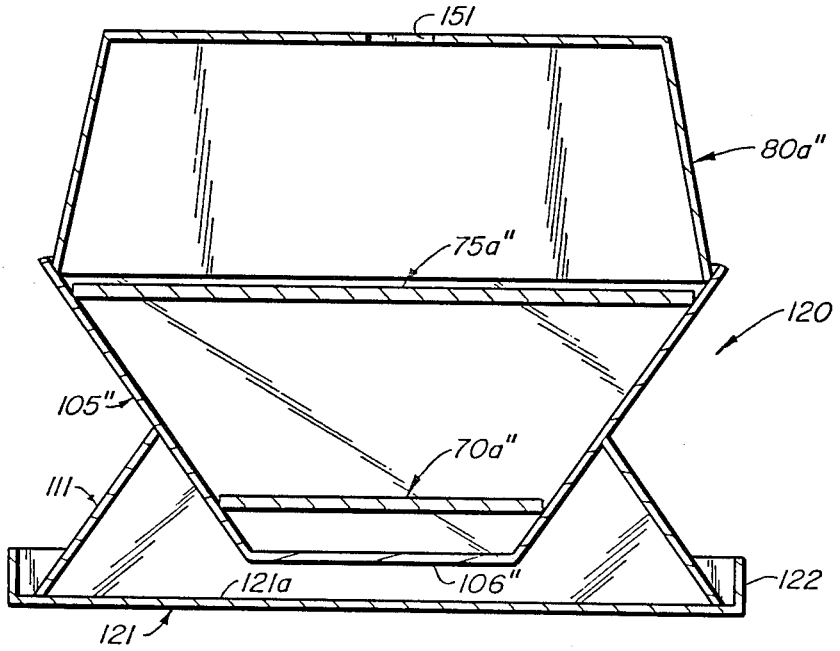
FIG. 8 is a vertical cross-section of the cooking unit similar to FIG. 7, but illustrating the base as being made of bendable, disposable and non-combustible sheet material.

Illustrated in FIG. 8 is a cooking unit 120, which is similar to the cooking unit 110 (FIG. 7) except for the base thereof. Hence, parts of the cooking unit 120 similar in construction and function to parts of the cooking unit 110 are designated with the same reference numeral and an added prime suffix. In the cooking unit 120, a quadrilateral base 121 is made of suitable bendable, non-combustible sheet material, such as aluminum foil above-described. The sheet material is foldable so that upstanding, perimetric flanges 122 can be formed on the base 121. A support member or support collar 111' seats on the base 121 within the perimetric flanges 122. The base 121 may, but need not have reflective surfaces.

Figure 9:
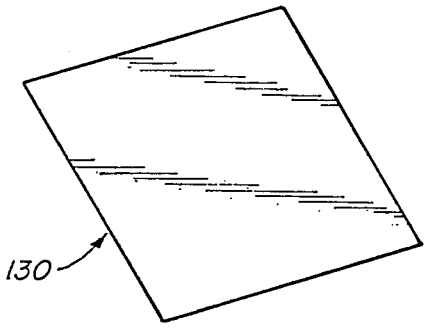
FIGS. 9–21 are diagrammatic sketches for illustrating the formation of the firebox liner shown in FIG. 2 as well as other components which are made of bendable, disposable and non-combustible sheet material.
Figure 10:
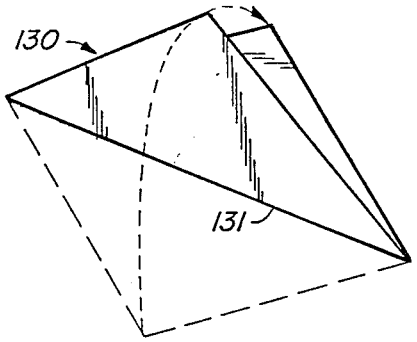
Figure 11:
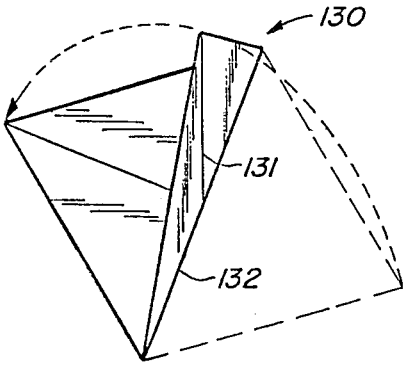
Figure 12:
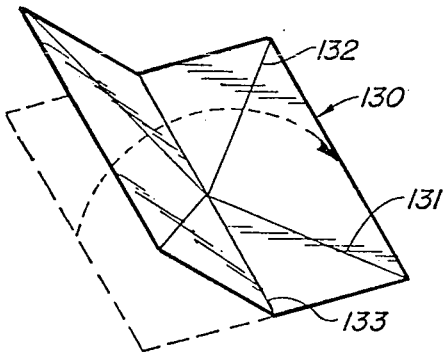
Figure 13:
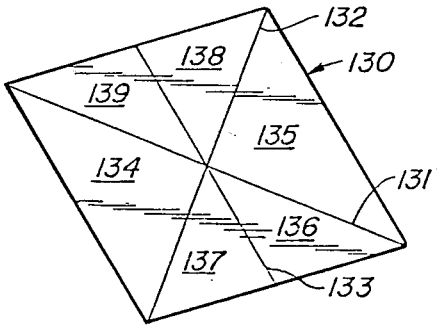
Figure 14:
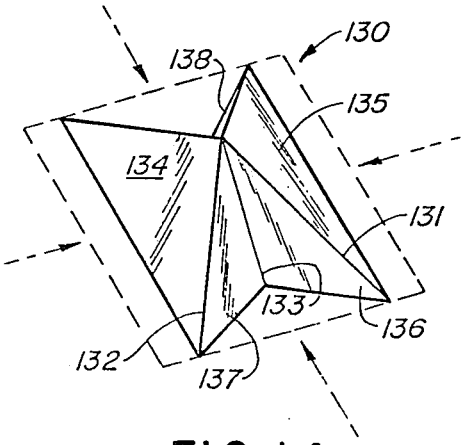
Figure 15:
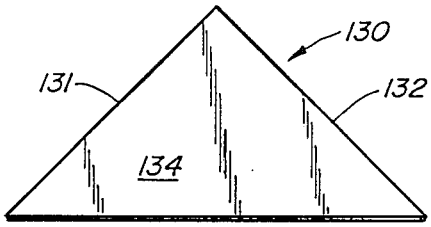

The liner 85 for the firebox 50 (FIGS. 2 and 3) may be formed from a square or rectangular sheet of metallic paper 130 (FIG. 9). A diagonal fold is formed by folding the sheet 130 about a fold line 131 (FIG. 10). The sheet 130 is unfolded and then folded about a diagonal fold line 132 (FIG. 11). Once again the sheet 130 is unfolded. A transverse fold line 133 (FIG. 12) is formed and the sheet 130 is again extended (FIG. 13). FIG. 12 is inverted with respect to FIGS. 10 and 11 when forming the transverse line 133. At this time, the sheet 130 is folded along the fold line 131–133 so that triangular section 134 is confronting triangular section 135 and each half of the fold line 133 will confront the other half of the fold line 133 to form triangular panels 136–139 (FIGS. 13 and 14). Triangular panel 136 will thereby confront triangular panel 138 and triangular panel 137 will confront triangular panel 139. The triangular panels 136 and 137 are contiguous and define a triangular section and the triangular panels 138 and 139 are contiguous and define a triangular section. A side view of the sheet 130 is shown in FIG. 15 illustrating the triangular section 134.

Figure 16:
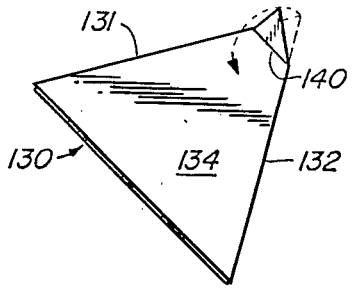
Figure 17:
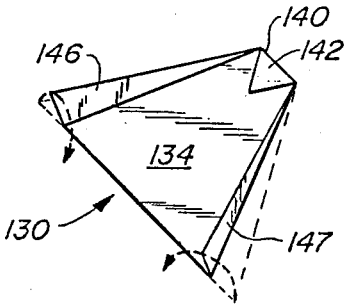
Figure 18:
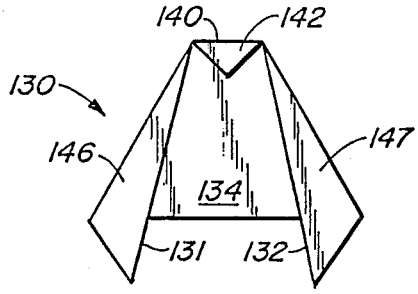
Figure 21:
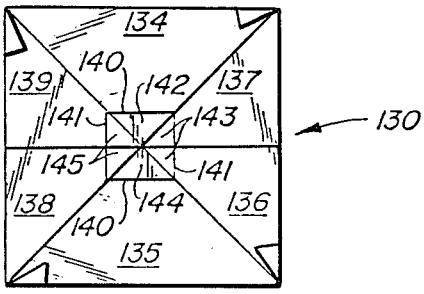

Now, the apex of the sheet 130 is folded along separate contiguous transverse lines 140 (FIGS. 16–18). Now, the apex of the sheet 130 is unfolded and then folded along separate contiguous transverse lines 141 (FIG. 21). The transverse lines 140 are in parallel relation and the transverse lines 141 are in parallel relation (FIG. 21). The transverse lines 140 are at right angles to the transverse lines 141, thereby forming a quadrilateral bottom wall comprising triangular sections 142–145 (FIG. 21). Four corner flaps 146–149 (FIGS. 17–19) are now folded. The flaps 146 and 147 are disposed against the triangular section 134 and the flaps 148 and 149 are disposed against the triangular section 135. The corners are now trimmed or folded inwardly. The extent of the fold angles for the flaps 146–149, respectively, determines the configuration of the liner. In the preferred embodiment, the extent of the fold angles for the flaps 146–149, respectively, is 60° to form a truncated pyramidal configuration.

Figure 19:
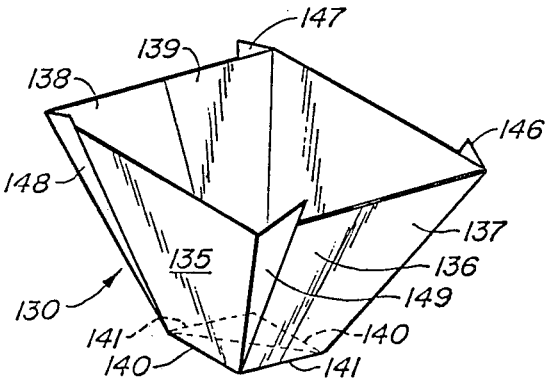
Figure 20:
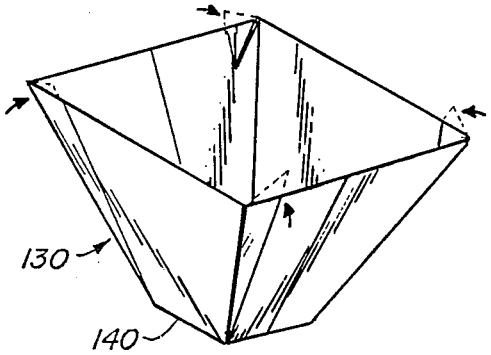

At this time, the sheet 130 is generally flat. To form an extended liner 85 for positioning against the inner surfaces of the firebox 50, the apex of the sheet 130 is urged toward the triangular sections 134–139 until the triangular sections 142–145 are disposed in the same plane to form a quadrilateral bottom wall and the sheet 130 becomes fully extended to form the liner 85 (FIGS. 19–21). The flaps 146–149 will remain contiguous with their associated triangular sections.

The firebox 105 may be formed in the manner above-described as may the support member 111, for the forming of the liner 85. In forming the hood 80, 80*a* and 80*a'*, the sheet 130 is flattened at the apex to a greater extent and a suitable opening 151 is formed in the top of the hood. The opening 151 provides an air flow path for the combustion of the fuel. It is apparent that the cooking unit of the present invention may be used without any hood. The hood can be positioned on the firebox to provide various size spaces for the flow of air and thereby control combustion by controlling air flow.

The liner 85, the firebox 105 and the support member 111 are folded into a flat state for storage. It is in a compact state while shipped or transported. To use the sheet 130 to assemble a cooking unit or to use the sheet 130 to form a liner for the firebox, a downward force is applied to the apex section from the interior of the folded sections and a pyramidal, truncated sheet material is extended to be used as a liner for a firebox, as a firebox, as a support member or as a hood.

In a relatively small cooking unit, the canned jellied alcohol and the solid fuel tablet may be employed for cooking food. In larger cooking units, the canned jellied alcohol and the solid fuel tablet may be employed for igniting briquets or the like.

I claim:

1. A bendable, non-combustible, disposable member for cooking unit in which is disposed a fuel element, said member comprising:

(a) a closed bottom made of bendable, non-combustible material; and (b) a plurality of panels extending upwardly from said bottom forming a member having an inverted truncated pyramidal configuration with an open top, each of said panels being made of bendable, non-combustible material;

(c) said closed bottom and said panels being made of metallic paper.

2. A bendable, non-combustible, disposable member for a cooking unit as claimed in claim 1 wherein each of said panels has a trapezoidal configuration.

3. A bendable, non-combustible, disposable member for a cooking unit as claimed in claim 2 wherein said closed bottom is a flat wall having a quadrilateral configuration.

4. A bendable, non-combustible, disposable member for a cooking unit as claimed in claim 2 wherein each of said panels joins contiguous panels at the non-parallel edges thereof by overlapping flaps.

5. A bendable, non-combustible, disposable member for a cooking unit as claimed in claim 4 wherein each of said overlapping flaps has an inverted triangular configuration.

6. A bendable, non-combustible, disposable member for a cooking unit as claimed in claim 5 wherein each of said overlapping flaps has its apex adjacent said bottom and its base adjacent said open top.

7. A bendable, non-combustible, disposable member for a cooking unit in which is disposed a fuel element, said member comprising:

(a) a closed bottom;

(b) a plurality of panels extending upwardly from said bottom forming an inverted truncated pyramidal configuration with an open top, and (c) said closed bottom and said panels being made of metallic paper, (d) each of said panels having a trapezoidal configuration, each of said panels joining contiguous panels at the non-parallel edges thereof by overlapping flaps, (e) each of said overlapping flaps having an inverted triangular configuration, each of said overlapping flaps having its apex adjacent said bottom and its base adjacent said open top, (f) the base of each of said overlapping flaps being folded over in the direction of said open top.

8. A bendable, non-combustible, disposable member for a cooking unit in which is disposed a fuel element, said member comprising:

(a) a closed bottom; and (b) a plurality of panels extending upwardly from said bottom forming an inverted truncated pyramidal configuration with an open top.

(c) said closed bottom and said panels being made of metallic paper, (d) each of said panels having a trapezoidal configuration, (e) said closed bottom being a flat wall having a quadrilateral configuration, (f) said closed bottom and said panels being initially folded state and opening to an extended state by the application of a downward force upon said bottom from the direction of said open top.

9. A bendable, non-combustible, disposable member for a cooking unit in which is disposed a fuel element, said member comprising:

(a) a closed bottom; and (b) a plurality of panels extending upwardly from said bottom forming an inverted truncated pyramidal configuration with an open top, (c) said closed bottom and said panel being made of metallic paper, (d) each of said panels having a trapezoidal configuration, each of said panels joining contiguous panels at the non-parallel edges thereof by overlapping flaps, (e) each of said overlapping flaps having an inverted triangular configuration, each of said overlapping flaps having its apex adjacent said bottom and its base adjacent said open top, (f) said closed bottom and said panels being initially in a folded state and opening to an extended state by the application of a downward force upon said bottom from the direction of said open top.

* * * * *